United States Patent [19]

Self et al.

[11] Patent Number: 4,609,215

[45] Date of Patent: Sep. 2, 1986

[54] HYDRAULIC LOCKING BOLTWORK SYSTEM

[75] Inventors: Henry L. Self, Oxnard; Teddy L. Pickett, Ventura, both of Calif.

[73] Assignee: The United States of America as represented by the Secretary of the Navy, Washington, D.C.

[21] Appl. No.: 642,289

[22] Filed: Aug. 20, 1984

[51] Int. Cl.[4] ..... E05B 47/00

[52] U.S. Cl. ..... 292/144; 292/33

[58] Field of Search ..... 292/144, 201, 33, 45; 70/275, 262; 49/449, 450

[56] References Cited

U.S. PATENT DOCUMENTS

| | | | |
|---|---|---|---|
| 2,688,865 | 9/1954 | Foster et al. | 70/275 X |
| 3,295,878 | 1/1967 | Houvener | 292/144 |
| 4,426,358 | 1/1984 | Johansson | 49/449 X |

*Primary Examiner*—Richard E. Moore

*Attorney, Agent, or Firm*—Robert F. Beers; Joseph M. St.Amand

[57] ABSTRACT

A hydraulic locking boltwork system includes a hand operated rotary actuator hydraulic pump and a plurality of hydraulic cylinders in which each cylinder rod drives a deadbolt into the door frame including the top, bottom, and/or sides. Hydraulic devices are plumbed into the system to block hydraulic lines and lock the system, and an alarm triggers and/or activates automatic relocking devices.

8 Claims, 4 Drawing Figures

HYDRAULIC LOCKING BOLTWORK SYSTEM

BACKGROUND OF THE INVENTION

The invention relates to means for locking large or small doors, which must be carefully secured, with several deadbolts. In particular, the invention relates to an hydraulic boltwork system which includes detection and automatic relocking means should unauthorized manipulation be attempted.

Present lockbolt systems are mechanically driven by gears or linkages which limit the number of deadbolts that can be operated, or are mechanical locks which incorporate an hydraulic latching system. Pneumatic latches use air which is compressible and thus can readily be forced open. Low pressure hydraulic latches have insufficient pressure to operate efficiently and are easily jammed. None of the prior art systems take advantage of the fact that liquids are incompressible and can become as rigid as a mechanical linkage for locking purposes, nor do they fully utilize the benefits of hydraulics to detect unauthorized lock manipulation. The prior art frequently uses inefficient mechanical linkages, or fluid pressure to open latch bolts and springs (which can easily be forced open) to close them. Efficient systems for locking the bolts closed are lacking.

SUMMARY OF THE INVENTION

The present system provides an hydraulic locking valve, and efficiently uses human power through use of a hand operated hydraulic rotary actuator or positive displacement pump as a power source.

The basic system of the present invention includes a hand operated hydraulic pump and several hydraulic cylinders. Each cylinder rod drives a deadbolt into the door frame top, bottom, and/or sides. Other hydraulic devices are plumbed into the system to block hydraulic lines (thus locking the system), to trigger alarms, and/or to activate automatic relocking devices, etc. A rotary actuator hydraulic pump is preferred since this allows a one stroke (half turn) to fully operate several hydraulic cylinders.

This system is capable of moving many lock bolts simultaneously with several rotations of a handle attached to a positive displacement pump, and is capable of moving large lock bolts for long travel distances and in applying great force to open or close lockbolts. Detection of unauthorized manipulation is signaled by pressure detection switches in the fluid lines, which also serve to cause the closing of hydraulic lines to automatically relock the system should an unauthorized entry be attempted. The invention also consists in the parts and in the arrangements and combinations of parts hereinafter described.

DESCRIPTION OF THE PREFERRED EMBODIMENTS

Figure 3:
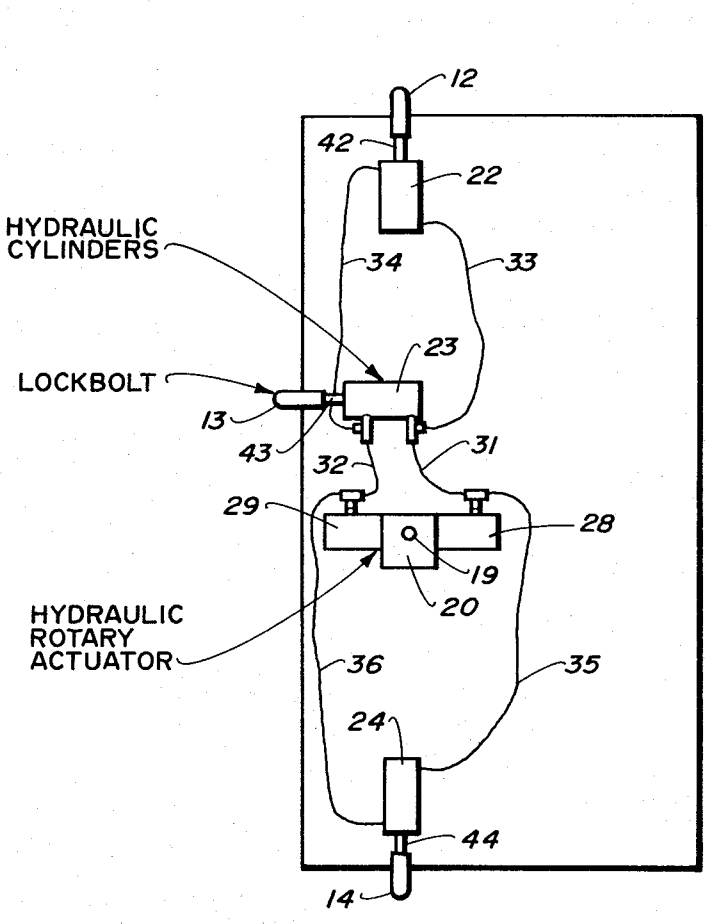
FIG. 3 is a rear view of the door of FIG. 1 diagrammatically showing the internal hydraulic system of the present invention.
Figure 2:
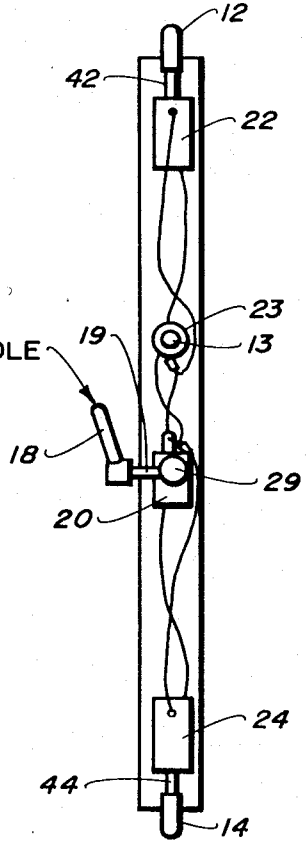
FIG. 2 is a cross-sectional side view of the door and system of FIG. 1.
Figure 1:
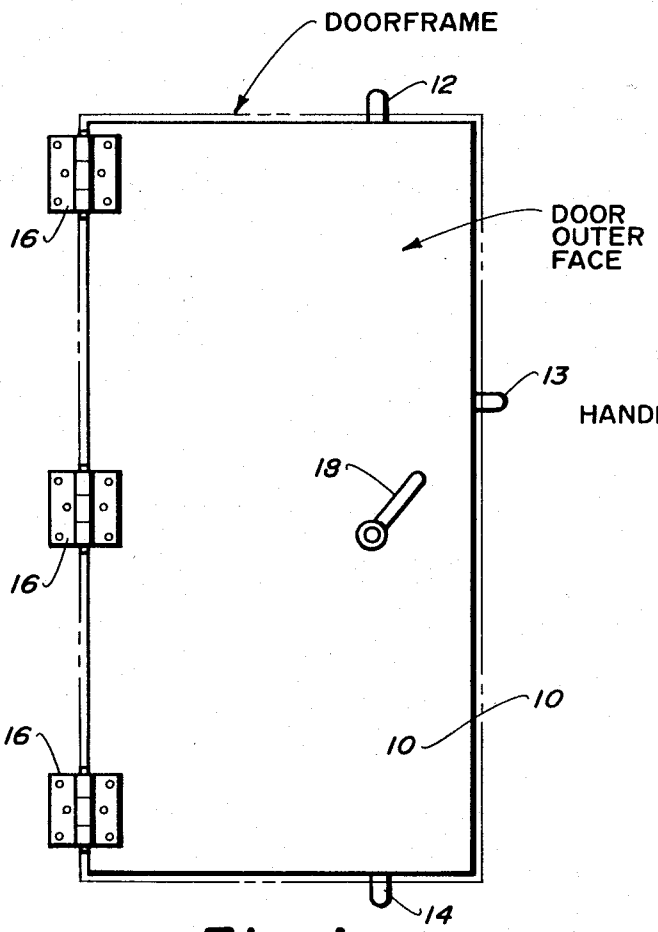
FIG. 1 is a front view of a door equipped with an hydraulic system of the present invention.
Figure 4:
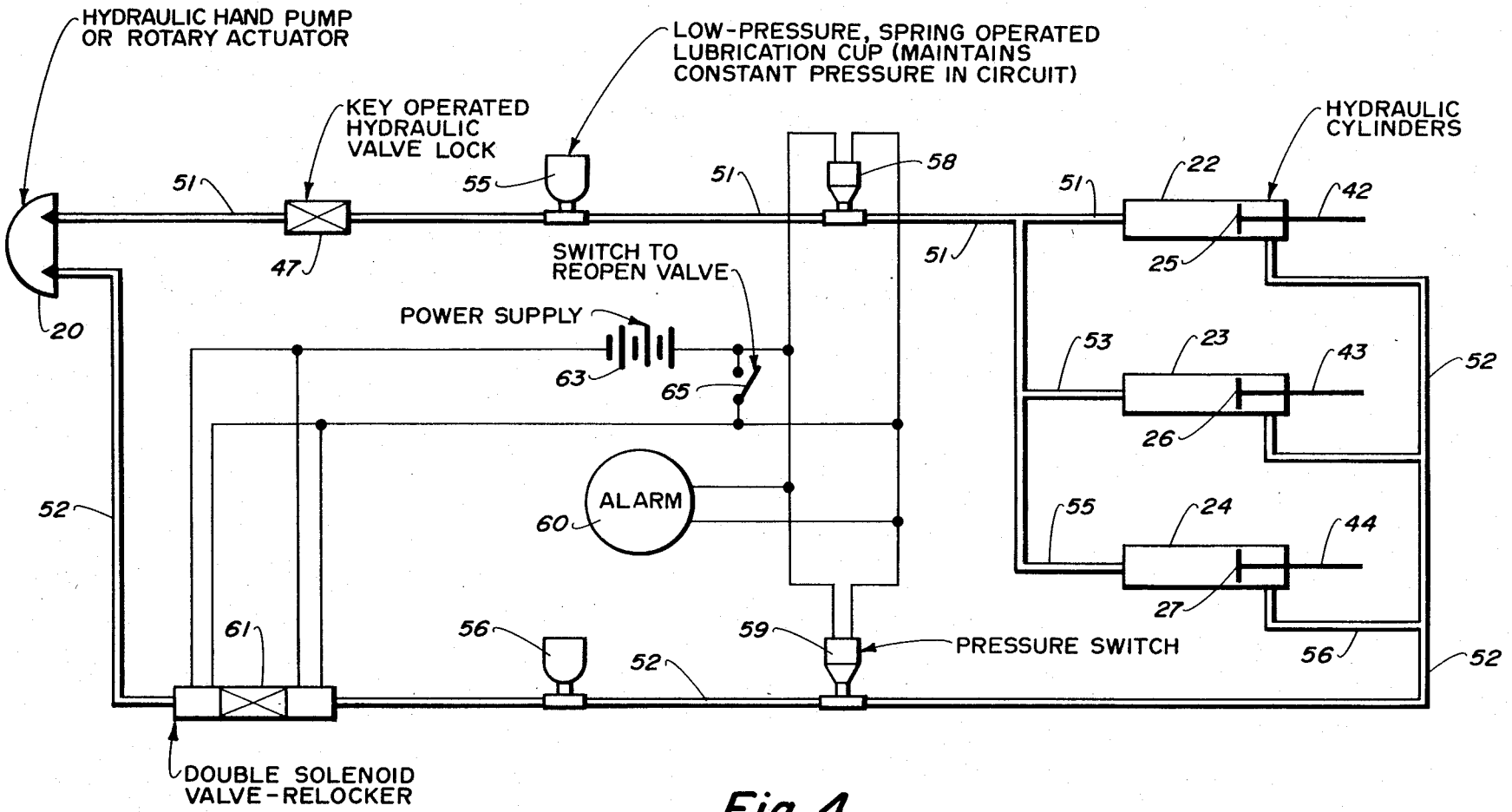
FIG. 4 is a schematic diagram of a preferred embodiment of the hydraulic locking boltwork system of the present invention showing locking, automatic relocking, detection and alarm features.

The hydraulic locking boltwork system is basically illustrated in a door in FIGS. 1, 2 and 3, and the basic hydraulic schematic is shown in FIG. 4. FIG. 1 shows a typical door 10 with three hydraulically driven deadbolts 12, 13 and 14, and hinged at 16 along one side. Handle 18, via shaft 19, operates an hydraulic rotary actuator (hydraulic pump) 20, as illustrated in FIGS. 2 and 3. Deadbolts 12, 13 and 14 are operated or driven by hydraulic cylinders 22, 23 and 24, respectively, mounted within door 10, as shown.

Hydraulic power is supplied by hand-operated hydraulic rotary actuator 20. When the shaft 19 of the rotary actuator is rotated clockwise (180° rotation, for example) hydraulic fluid is forced out of the right side 28 of the acutator and hydraulic fluid drawn into the left side 29. Rotating the actuator counter-clockwise forces hydraulic fluid out left side 29 and draws it into the right side 28. Hydraulic cylinders 22, 23 and 24 are connected to rotary actuator 20 via hydraulic lines or tubing 31 and 32, 33 and 34, 35 and 36. When the rotary actuator shaft is rotated clockwise rods 42, 43 and 44 are extended, moving deadbolts 12, 13 and 14, respectively, into the door frame and floor (or a second door, etc.), as illustrated in FIG. 1, for securely pinning and locking the door closed. Hydraulic cylinder rods 42, 43 and 44, together with deadbolts 12, 13 and 14, are retracted when shaft 19 of rotary actuator 20 is rotated counter-clockwise back to its original position. Three hydraulic cylinders with deadbolts are shown in FIGS. 1, 2 and 3, but any number of hydraulic cylinders, as desired, can be connected to one rotary actuator depending upon the capacity of the actuator. The capacity of the rotary actuator is chosen for the particular number of hydraulic cylinders to be operated, their size, and required stroke.

As illustrated in the schematic of FIG. 4, when fluid is fed to hydraulic cylinders 22, 23 and 24, pistons 25, 26 and 27, respectively, together with rods 42, 43 and 44 are moved accordingly. When rotary actuator 20 is rotated clockwise, fluid is forced via hydraulic lines 51, 53 and 55 into cylinders 22, 23 and 24 forcing pistons 25, 26 and 27 to move their respective rods 42, 43 and 44 outward while fluid is drawn out of the other ends of the cylinders via lines 52, 54 and 56. When activator 20 is rotated counter-clockwise the piston rods are forced back into the cylinders. The system can be locked by use of a key operated valve 47 which is used to block the flow of hydraulic fluid in any (or several) of the hydraulic lines. In the schematic diagram of FIG. 4, hydraulic rotary actuator 20 is connected via hydraulic lines 51, 52 and branch lines to hydraulic cylinders 22, 23 and 24. By way of example, key operated hydraulic valve lock 47 is located in hydraulic line 51. Low pressure, spring operated lubrication cups 55 and 56 which maintain constant pressure in the hydraulic circuit are mounted in hydraulic lines 51 and 52, respectively. While maintaining a small pressure on each side of rotary actuator 20, the cups 55 and 56 also compensate for leaks in the plumbing. With the use of lubrication cups 55 and 56 in the system, pressure switches 58 and 59 can be used to activate an alarm 60 connected to the switches whenever pressure in the hydraulic system drops or raises beyond set levels, as might occur if someone were to tamper with the locking system. A preferred system, however, uses one or more electrically powered solenoid valves 61 (e.g., double solenoid valves) in hydraulic lines 51 and/or 52, etc., which are electrically connected to pressure switches 58 and 59 and which automatically relock the system by closing the hydraulic lines in the event of an unauthorized change of system pressure, or tampering with lock 47. A power supply 63 is used to operate solenoid valves 61, and switch 65 is used to reopen a valve after it has been closed. A highly sophisticated fluidic valving arrangement that would in effect function as a combination lock may be used, if desired.

The present system allows as many locking deadbolts as desired to be operated with one driving mechanism located adjacent to or remote from the hydraulic cylinders. The invention also allows the locking bolts to be located in unlikely locations to frustrate intruders or at points which are difficult to reach with mechanical linkages.

There are several alternative hand-operated pumps. Hydraulic pumps are available that operate much like an automobile jack except that they are connected to an hydraulic cylinder through hoses. This type of pump may be used to operate several locking systems located near each other by carrying the pump from lock to lock and connecting into the hydraulic plumbing system with quick-connect couplings.

Obviously many modifications and variation of the present invention are possible in light of the above teachings. It is therefore to be understood that within the scope of the appended claims the invention may be practiced otherwise than as specifically described.

What is claimed is:

1. An hydraulic locking boltwork security system with automatic secondary relocking capability for securing doors having a plurality of deadbolts, comprising:

a. a manually operated hydraulic pump means for forcing in and withdrawing hydraulic fluid from hydraulic circuit lines;

b. a plurality of hydraulic cylinder and piston devices connected via hydraulic circuit lines to said hydraulic pump means; said hydraulic cylinder and piston devices including piston drive rods operable to be moved outwardly and inwardly as hydraulic fluid is forced into and out of the hydraulic circuit lines by operation of said hydraulic pump means;

c. a plurality of deadbolt means each of which is associated with a respective one of the piston drive rods of said plurality of hydraulic cylinder and piston devices; said deadbolt means being mounted about the outer perimeter area of a door whereby said hydraulic pump means is operable to move said piston drive rods and deadbolt means in a first direction for locking the door and in a second direction for unlocking said door;

d. means included in said hydraulic circuit lines for maintaining constant hydraulic fluid pressure;

e. detection means included in at least one hydraulic circuit line for indicating hydraulic system tampering;

f. a first manually operated hydraulic valve lock means located in at least one of the hydraulic circuit lines for closing said hydraulic lines to hydraulic fluid flow; and g. a secondary relocking means in at least one of said hydraulic circuit lines cooperating in conjunction with said detection means and which operates to close said hydraulic circuit lines for automatically locking the system upon detection by said detection means of an unauthorized change in hydraulic system pressure.

2. A system as in claim 1 wherein said constant pressure means is a low pressure, lubrication cup device mounted in at least one of said hydraulic circuit lines.

3. A system as in claim 1 wherein said detection means includes an alarm means which activates whenever pressure in the hydraulic system drops or raises beyond set levels.

4. A system as in claim 3 wherein said detection means includes hydraulic fluid pressure operated electrical switches.

5. A system as in claim 1 wherein said automatic relocking means comprises a double solenoid valve.

6. A system as in claim 5 wherein an electrical power source is provided, connected to said double solenoid valve, for reopening said relocking means once it has been closed.

7. A system as in claim 4 wherein said secondary relocking means is also actuated by said detection means.

8. A system as in claim 1 wherein said hydraulic pump means is a portable hydraulic hand pump.

* * * * *